United States Patent [19]

Bus et al.

[11] 4,326,979

[45] Apr. 27, 1982

[54] NON-AQUEOUS, BUILT LIQUID DETERGENT COMPOSITION AND METHOD FOR PREPARING SAME

[75] Inventors: Jan Bus, Krimpen; Willem M. M. Möhlmann, Vlaardingen; Norman J. Pritchard, Bilthoven, all of Netherlands

[73] Assignee: Lever Brothers Company, New York, N.Y.

[21] Appl. No.: 203,076

[22] Filed: Oct. 31, 1980

[30] Foreign Application Priority Data

Nov. 9, 1979 [GB] United Kingdom ..... 38986/79

[51] Int. Cl.[3] ..... C11D 7/06; C11D 7/50

[52] U.S. Cl. ..... 252/158; 252/135; 252/162; 252/174.24

[58] Field of Search ..... 252/174.24, 158, 159, 252/162, 104, 103, 135

[56] References Cited

U.S. PATENT DOCUMENTS

| | | | |
|---|---|---|---|
| 3,208,949 | 9/1965 | Rosnati | 252/174.24 X |
| 3,235,505 | 2/1966 | Tuveu | 252/174.24 X |
| 3,764,559 | 10/1973 | Mizuno et al. | 252/174.24 X |

*Primary Examiner*—Mayer Weinblatt

*Attorney, Agent, or Firm*—Melvin H. Kurtz

[57] ABSTRACT

The invention relates to non-aqueous, built liquid detergent compositions. By a judicious choice of surfactant, solvent, alkaline material and builder, and the use of an at least partially hydrolyzed copolymer of maleic anhydride and ethylene or vinylmethylether, stable compositions are obtained.

The method of making same requires first dissolving the copolymer in the solvent before the other ingredients are added.

9 Claims, No Drawings

NON-AQUEOUS, BUILT LIQUID DETERGENT COMPOSITION AND METHOD FOR PREPARING SAME

The present invention relates to an improved non-aqueous, built liquid detergent composition.

Non-aqueous, built liquid detergent compositions have already been proposed in the art. Thus, U.S. Pat. Nos. 2,864,770, 2,940,938 and U.K. Pat. No. 1,008,016 describe non-aqueous, built liquid detergent compositions, comprising a colloidal suspension of a polyphosphate builder salt in a liquid vehicle, which may be a nonionic detergent or a short-chain glycol. These prior proposals require careful processing, and require very fine polyphosphate builder salts.

U.K. Pat. Nos. 1,205,711, 1,270,040 and 1,292,352 describe substantially non-aqueous, built liquid detergent compositions in which the builder salts are suspended in a liquid medium by means of an inorganic, highly voluminous carrier material. These compositions however show either an undesirable syneresis, or are not sufficiently pourable for practical purposes.

Another prior proposal, U.S. Pat. No. 3,368,977, describes a non-aqueous built liquid detergent composition, comprising an anionic detersive surfactant, a solvent for the surfactant, and a phosphate builder salt in suspension in the liquid. The surfactant must be soluble in the solvent, which restricts the choice thereof, and the phosphate builder salt should be of a very finely divided type, as otherwise no stable suspensions are obtained.

In addition, U.K. Pat. No. 1,370,377 discloses a non-aqueous liquid detergent composition, comprising a solid particulate water-soluble salt dispersed in a liquid medium, an anionic surface-active agent and a suspending agent. The particle size of the inorganic salt should be such that it can act as an abrasive. The suspending agent confers Bingham plastic character to the composition, and is for example a highly voluminous inorganic carrier material as in U.K. Pat. No. 1,205,711.

Again the storage stability of these compositions does not seem to be satisfactory for many practical purposes, a period of two weeks being mentioned in this patent.

Finally, German Patent Application No. 2,233,771, laid open to public inspection on 1st Feb. 1973, describes non-aqueous built liquid detergent compositions comprising a bleaching agent, a builder salt, a liquid detergent and a polyol or an ether of a polyol as solvent. Again this composition requires a very fine division of the solid material therein, and the products obtained are very viscous indeed, in fact paste-like.

Therefore, in the prior art there has been no lack of proposals for non-aqueous built liquid detergent compositions, but so far no generally satisfactory compositions have been proposed.

The present invention has as an object to overcome and/or significantly reduce the drawbacks of these prior proposals.

It has been found that this object, and others, can be achieved by using a specific type of suspension stabilizer in a non-aqueous, solvent-containing medium.

Indeed, it has been found that the use of an at least partially hydrolyzed copolymer of maleic anhydride with ethylene or vinylmethylether in a non-aqueous, solvent-containing liquid medium, in the presence of a strongly alkaline material, provides for a liquid medium in which builder salts can be stably suspended. These compositions show a storage stability of 2% or less phase separation per month.

In essence therefore, the present invention relates to a substantially non-aqueous, built liquid detergent composition comprising as essential ingredients:

(1) a surface-active detergent material
(2) a solvent
(3) an at least partially hydrolyzed copolymer of maleic anhydride with ethylene or vinylmethylether
(4) a strongly alkaline material, and
(5) a builder salt, and, if necessary,
(6) a buffer.

These essential ingredients will be discussed below in more detail.

The Surface-active Detergent Material

It is essential that the surface-active material is either liquid at room temperature, or liquefiable at room temperature, e.g. by forming a solution with the solvent. Bearing these requirements in mind, suitable surface-active detergents may be found in the classes of soaps and non-soap detergents, e.g. the anionic, cationic, amphoteric, zwitterionic and nonionic detergent surfactants, or mixtures thereof.

A preferred group of suitable detergent surfactants is the group of nonionic surfactants. Nonionic detergent surfactants are well known in the art. They normally consist of a water-solubilizing polyoxyalkylene group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols having from 8 to 20 carbon atoms, monocarboxylic acids having from 10 to about 24 carbon atoms in the alkyl group, polyoxypropylene, fatty acid mono- and dialkylolamides in which the alkyl group of the fatty acid radical contains from 10 to about 20 carbon atoms and the alkylol group is a lower alkylol group having from 1 to 3 carbon atoms, and ethoxylated derivatives thereof, for example tallow fatty acid amide condensed with 20 moles of ethylene oxide. The nonionic detergent surfactants normally have molecular weights of from about 300 to about 11,000.

Mixtures of different nonionic detergent surfactants may also be used. Mixtures of nonionic detergent surfactants with other detergent surfactants such as anionic, cationic and ampholytic detergent surfactants and soaps may also be used, but again such mixtures must be liquid or liquefiable at room temperatures.

Especially preferred are those nonionics in which the organic hydrophobic group contains both ethylene oxide and propylene oxide moieties. Typical examples thereof are primary $C_{13}$–$C_{15}$ alcohols, condensed with 7–9 moles of ethylene oxide plus propylene oxide, the alkylene oxides being used in a weight ratio of e.g. 92:8.

The amount of the surface-active detergent material, present in the composition, is generally from 5 to 45%, preferably from 8 to 20%, and particularly preferably from 10 to 12%.

The Solvent

The solvent is also critical, in that the at least partially hydrolyzed copolymer should be soluble therein. Basically, those solvents can be used in which the at least partially hydrolyzed copolymer under the following standard conditions shows a solubility of at least 1.5% by weight, after having been dissolved at about 80° C. in the solvent until a clear solution is obtained. The solvent molecules should bear at least one hydroxyl group.

Although not critical, it is beneficial to use those solvents in which also, in case solid or liquefiable surface-active detergents are used, the latter can be dissolved.

Typical examples of suitable solvent, meeting the above requirement with regard to the at least partially hydrolyzed copolymer, are triethyleneglycol monoethylether, ethyleneglycol monoethylether, ethyleneglycol mono-n-butylether, diethyleneglycol monomethylether, diethyleneglycol, monoethylether, diethyleneglycol mono-n-butylether, 4-hydroxy-4-methyl-2-pentanone, and polyethyleneglycols with an average molecular weight of 200–3,000. Mixtures of these solvents can also be used. The above-specified ether-type solvents are preferred, of which triethyleneglycol monoethylether is the preferred representative. Ethanol can also be used, but only in conjunction with one of the above solvents.

The solvent is generally present in the composition in an amount of from 5 to 60%, preferably from 25 to 35%, and particularly from 28 to 32%. The weight ratio of solvent to surface-active detergent material may vary widely, but in order to obtain compositions which can easily be dispensed, the ratio is preferably from 3:1 to 1:1.

The Copolymer

The copolymer is an at least partially hydrolyzed hydrolyzable copolymer of maleic anhydride with ethylene or vinylmethylether. These hydrolyzable copolymers as such are well known in the art; they are described, for instance, in U.S. Pat. No. 3,328,309.

It is essential that these copolymers are used in an at least partially hydrolyzed form. The copolymer must be hydrolyzed for at least 30% and preferably for about 50%, whereby the percentage is based upon the total number of maleic anhydride groups originally present in the copolymer. The copolymer may also be completely hydrolyzed. The at least partially hydrolyzed copolymer is generally present in an amount of from 0.1 to 1.0%, preferably from 0.25 to 0.7%, and particularly from 0.2 to 0.4%.

The Strongly Alkaline Material

Essential for the role of the at least partially hydrolyzed copolymer as stabilizer in the composition of the invention is the presence of a strongly alkaline material in a finely divided form in the composition. The mean particle size of this material should be less than 50 micrometers. The strongly alkaline material to be used in the present invention is one which, when dissolved in distilled water at 20° C., at a concentration of 1% by weight, yields a pH of $\geqq 10$. Suitable examples of inorganic materials are sodium(di)silicate, sodium hydroxide, sodium and carbonate, sodium sesquicarbonate, and trisodium orthophosphate, and suitable examples of organic materials are ethylene diamine, hexamethylene diamine, diethylamine and propylamine. The strongly alkaline material may also act as a buffer in the system; if it does not provide for a sufficient buffering capacity, an additional buffer, such as borates, may be added.

In general, the strongly alkaline material is present in the composition in an amount of from 2.5 to 20%, preferably from 5 to 15%, and particularly from 11 to 13%.

The Builder Salt

The builder salt in the present invention may be any suitable organic and/or inorganic builder salt. Typical examples thereof are the alkali metal ortho-, pyro-, meta- and tripolyphosphates, alkali metal carbonates, -silicates, sodium aluminosilicates (zeolites), sodium carboxymethyloxy succinate, sodium carboxymethyloxy malonate, sodium citrate, salts of amino polycarboxylic acids such as NTA, etc. In general, these builder salts are present in an amount of from 1 to 70%, preferably from 10 to 60%, and particularly from 20 to 50%.

The compositions of the invention may furthermore contain ingredients commonly incorporated in liquid detergents, such as bleaching agents, bleach activators, hydrotropes, enzymes, enzyme-stabilizing agents, fluorescers, soil-suspending agents, anti-soil redeposition agents, perfumes, bactericides, corrosion inhibitors, foam boosters, foam depressors, (co)solvents not containing a hydroxyl group, softening agents, all without substantially modifying the fundamental characteristics of the composition of the invention.

In this respect it is of advantage that all suspended particles are of a size less than 50 micrometers.

It has also been found that the addition of certain other polymers can further improve the stability of the final composition. Typical examples of such polymers are polyethylene oxide waxes (MW up to a few million; viscosity 2,000–4,000 cP at 1% conc.) and hydroxypropylcellulose (viscosity 5% aqueous solution 150–400 cP (Brookfield LVF). These polymers can be present in an amount of from 0.05 to 0.7%, preferably from 0.1 to 0.4%.

The compositions of the present invention can be made by any suitable mixing process. It is, however, an essential process condition that the at least partially hydrolyzed copolymer is dissolved in the solvent at about 80° C. to a clear solution before any of the other components are added. To the solution thus obtained, the detergent-active material can be added, and subsequently the strongly alkaline material under thorough agitation. If the at least partially hydrolyzed copolymers are not available as such, they must be prepared prior to admixture with the other ingredients. This can be done separately by, for example, spraying the required amount of water on the anhydrous copolymer in its anhydride form in a suitable mixing vessel.

The present invention will further be illustrated by way of example.

If a completely hydrolyzed copolymer is used, it is dissolved in the solvent and kept at about 80° C. until the $[H^+]$ (in mg eq/g solution) is from 0.79–88, preferably from 0.82–0.84 (measured as a 10% by weight solution in triethyleneglycol monoethylether).

Examples A–E

| | A | B | C | D | E |
|---|---|---|---|---|---|
| $C_{13}$–$C_{15}$ primary alcohol, condensed with 7 moles of EO + PO (weight ratio of EO:PO = 92:8) | 36.1 | 36.1 | 36.1 | 35.8 | 35.8 |
| Triethyleneglycol monoethylether | 12 | 12 | 12 | 12 | 12 |
| Ethanol 100% | 3 | 3 | 3 | 3 | 3 |
| Sodium tripolyphosphate 6 aq | 40 | 40 | 40 | 40 | 40 |

Examples A–E-continued

| | A | B | C | D | E |
|---|---|---|---|---|---|
| Sodiumdisilicate | 7 | 7 | 7 | 7 | 7 |
| Fluorescers | 0.3 | 0.3 | 0.3 | 0.3 | 0.3 |
| Perfume | 0.2 | 0.2 | 0.2 | 0.2 | 0.2 |
| Alcalase (proteolytic enzyme ex *B. subtilis*) | 0.7 | 0.7 | 0.7 | 0.7 | 0.7 |
| Colorant | trace | trace | trace | trace | trace |
| Copolymer of vinylmethylether with maleic anhydride with spec. viscosity (25° C.) of 0.1–0.5 (1 g/100 ml) methylethylketone, hydrolysed for 50% | 0.7 | — | — | 0.7 | 0.7 |
| Copolymer of vinylmethylether with maleic anhydride with spec. viscosity (25° C.) of 0.1–0.5 (1 g/100 ml) methylethylketone, hydrolysed for 20% | — | 0.7 | — | — | — |
| Copolymer of vinylmethylether with maleic anhydride with rel. viscosity (1% aq. solution) of 1–3, hydrolysed for 100% | — | — | 0.7 | — | — |
| Polyox WSR 301 (a high-molecular weight polyalkyleneoxide wax, ex Union Carbide, with a viscosity of 2000–4000 cP at 1% aqueous concentration) | — | — | — | 0.3 | — |
| Klucel J (a hydroxy propyl cellulose ex Hercules Powder Co). (visc. 5%) aq. solution 150–400 cP (Brookfield LVF) | — | — | — | — | 0.3 |
| | 100 | 100 | 100 | 100 | 100 |
| Phase separation per month | 1% | 20% | 2% | 0.7% | 0.25% |

These examples show the criticality of the lower degree of hydrolysis of the copolymer.

Replacing the copolymer with the specific viscosity of 0.1–0.5 by the same copolymers, but with specific viscosities of 1.0–1.4, 1.5–2.0, and 2.6–3.5 give analogous results.

EXAMPLES F–M

The following products were prepared:

| | Parts |
|---|---|
| triethylene glycol monoethylether | 25.95 |
| nonionic detergent | 12.7 |
| sodium tripolyphosphate 6 aq. | 40.0 |
| sodium disilicate | 12.0 |
| copolymer of vinyl methylether with maleic anhydride ($\eta_{sp}$ 0.1–0.5) hydrolysis degree 50% | 0.5 |
| ethanol | 3.0 |
| hydroxy propylcellulose (as in Example E) | 0.3 |

The nonionic detergent was varied in these products as follows, and the following percentages phase separation were measured:

| | % phase-separation after 9 weeks |
|---|---|
| F: $C_{13}$–$C_{15}$ primary alcohol, condensed with 8–9 moles of EO + PO (weight ratio 92:8) | 1.4 |
| G: id., but condensed with 7 moles of EO + PO (weight ratio 92:8) | 1.3 |
| H: $C_{10}$–$C_{12}$ primary alcohol, condensed with 7 moles of EO + 1 mole PO | 1.5 |
| I: $C_9$–$C_{11}$ primary alcohol, condensed with 6 moles of EO | 0.7 |
| K: $C_{13}$–$C_{15}$ primary alcohol, condensed with 11 moles of EO | 0.7 |
| L: nonylphenol condensed with 10 moles of EO | <0.5 |
| M: $C_{11}$–$C_{15}$ sec. alcohol, condensed with 9 moles of EO | 0.8 |

Examples N–R

| | The following products were prepared (%): | | | | | |
|---|---|---|---|---|---|---|
| | N | O | P | Q | R | S* |
| sodium tripolyphosphate 6 aq. | 40 | 40 | 40 | 27 | 40 | 25.6 |
| sodium disilicate | 12 | 12 | 12 | — | 12 | 4.0 |
| copolymer (as in Ex. F–M) | 0.5 | 0.5 | 0.3 | 0.3 | 0.3 | 0.3 |
| hydroxypropyl cellulose (as in Ex. F–M) | 0.3 | 0.3 | 0.3 | 0.3 | 0.3 | 0.3 |
| ethanol | 3.0 | 3.0 | — | — | 34.7 | 3.0 |
| $C_{13}$–$C_{15}$ primary alcohol, condensed with 8 moles of (EO + PO) (weight ratio 88:12) | 22.1 | 14.7 | 10 | 14.3 | 12.7 | 15.1 |
| triethyleneglycol monoethylether | 22.1 | 29.5 | 37.4 | 38.1 | — | 37.9 |
| sodium orthophosphate | — | — | — | 7.0 | — | — |
| sodium perborate monohydrate | — | — | — | 13.0 | — | 11.8 |
| phase separation per month | 1.5 | 0.5 | 0.7 | 0.5 | 3.0 | <1% |

Example R shows that ethanol alone does not provide for a satisfactory medium.
*further containing: 0.2% fluorescer, 1.0% SCMC, 0.2% EDTA, 0.2% perfume, 0.4% enzyme slurry (Alcalase® 1450 GU/mg).

We claim:

1. A non-aqueous, built liquid detergent composition consisting essentially of:
   (a) from 5–45% by weight of a nonionic surface-active detergent material which is a liquid or liquefiable at room temperature;
   (b) from 0.1–1% by weight of an at least 30% hydrolyzed, hydrolyzable copolymer of maleic anhydride with ethylene or vinylmethylether;
   (c) from 5–60% by weight of a hydroxyl group-containing solvent, in which the partially hydrolyzed copolymer (b) shows a solubility of at least 1.5% by weight after having been dissolved at about 80° C.;

(d) from 2.5–20% by weight of an alkaline material having a mean particle size of less than 50 micrometers, and yielding a pH (1% by weight aqueous solution at 20° C.) of equal to or higher than 10; and (e) from 1–70% by weight of a builder salt.

2. A composition according to claim 1 which has
from 8–20% by weight of (a)
from 0.25–0.7% by weight of (b)
from 25–35% by weight of (c)
from 5–15% by weight of (d), and
from 10–60% by weight of (e).

3. A composition according to claim 2 which has
from 10–12% by weight of (a)
from 0.2–0.4% by weight of (b)
from 28–32% by weight of (c)
from 11–13% by weight of (d), and
from 20–50% by weight of (e).

4. A composition according to claim 1, further comprising from 0.05–0.7% by weight of a polymer selected from the group consisting of polyethylene oxide waxes with a molecular weight of up to a few million, and a viscosity of 2,000–4,000 cP in a 1% aqueous solution (25° C.), and hydroxypropylcellulose with a viscosity of 150–400 cP (Brookfield LVF in a 5% aqueous solution at 25° C.).

5. A composition according to claim 4 wherein said polymer is from 0.1–4% by weight.

6. A composition according to claim 1, wherein the nonionic surface-active material is mixed with anionic, cationic or ampholytic surfactants, the copolymer is hydrolyzed at least 50%, the solvent is triethyleneglycol monoethylether, the alkaline material is sodium disilicate and the builder salt is sodium tripolyphosphate.

7. A process for making a composition according to claim 1, wherein the partially hydrolyzed copolymer is first dissolved in the solvent at 80° C. until a clear solution is obtained, after which the other components are added.

8. A process for making a composition according to claim 1, wherein the completely hydrolyzed copolymer is first dissolved in the solvent at 80° C. until the hydrogen ion concentration of the resulting solution is from 0.79–0.88 mg eq/g solution (measured as a 10% by weight solution in triethyleneglycol monoethylether, after which the other components are added.

9. A process for making a composition according to claim 1 wherein the completely hydrolyzed copolymer is first dissolved in the solvent at 80° C. until the hydrogen ion concentration of the resulting solution is from 0.82–0.84 mg eq/g solution (measured as a 10% by weight solution in triethyleneglycol monoethylether), after which the other components are added.

* * * * *

UNITED STATES PATENT AND TRADEMARK OFFICE

CERTIFICATE OF CORRECTION

PATENT NO. : 4,326,979

DATED : April 27, 1982

INVENTOR(S) : Bus et al

It is certified that error appears in the above—identified patent and that said Letters Patent is hereby corrected as shown below:

Claim 5, line 2, "from 0.1-4%" should read -- from 0.1-0.4% --.

Signed and Sealed this

Second Day of August 1983

[SEAL]

Attest:

GERALD J. MOSSINGHOFF

Attesting Officer

Commissioner of Patents and Trademarks